US005291713A

United States Patent [19]

Brechbühler

[11] Patent Number: 5,291,713

[45] Date of Patent: Mar. 8, 1994

[54] CONSTRUCTION ELEMENT FOR LIMITING THE FORE PART OF A FORMWORK

[75] Inventor: Fritz Brechbühler, Münsingen, Switzerland

[73] Assignee: Brefeba N.V., Willemstad, Netherlands Antilles

[21] Appl. No.: 900,949

[22] Filed: Jun. 17, 1992

[30] Foreign Application Priority Data

Jun. 17, 1991 [EP] European Pat. Off. ..... 91810456.3

[51] Int. Cl.[5] ..... E04C 2/38

[52] U.S. Cl. ..... 52/606; 52/364; 52/421; 249/84

[58] Field of Search ..... 52/699, 100, 364, 421, 52/723, 606 OR; 249/84

[56] References Cited

U.S. PATENT DOCUMENTS

| | | | |
|---|---|---|---|
| 2,631,450 | 3/1953 | Lachaise | 52/723 |
| 3,990,200 | 11/1976 | Kawasaki | 249/84 |
| 4,118,906 | 10/1978 | Preuninger et al. | 52/100 |
| 4,506,481 | 3/1985 | Witschl | 52/364 |
| 4,909,002 | 3/1990 | Clifton et al. | 52/100 |

*Primary Examiner*—Carl D. Friedman
*Assistant Examiner*—Wynn E. Wood
*Attorney, Agent, or Firm*—Richard Linn

[57] ABSTRACT

A construction element for limiting a fore part of a formwork consists of a prefabricated element having a width which corresponds to the thickness of the construction work to be erected and a modular length. The element comprises openings for being able to push through reinforcing irons, pipework or the like tubes. Because the element is foreseen to remain in the wall, it is produced preferably with a relatively fine concrete in which a reinforcing mesh of synthetic material is enclosed, which extends also over the openings and prevents the outflow of concrete at the time of pouring the latter into the formwork. Such a shuttering element allows a fast and precise limiting of the formwork in the case the construction work is not poured in one part or is needing recesses for a crane. It requires no cleaning off or pulling off wooden parts when the joining part is produced.

7 Claims, 2 Drawing Sheets

CONSTRUCTION ELEMENT FOR LIMITING THE FORE PART OF A FORMWORK

BACKGROUND OF THE INVENTION

The invention relates to a construction element for limiting a fore part of a formwork, said element being prefabricated and of concrete having a width corresponding to the thickness of the concrete work to be erected and a modular length, comprising openings to allow the pushing through of reinforcing irons, pipework, or tubes and provided with a reinforcement mesh which extends also into the openings arranged in rows and preventing the outflow of concrete at the time of its pouring into the formwork.

It is often not possible to erect concrete works like walls, floorings or ceilings in a single pass, so that the formwork has to be limited, that is closed at the place until the concrete is provided. This happens particularly when erecting walls with wooden boards which are cut to the right dimensions in situ and which have to be provided there with openings for the pushing through of the reinforcing irons. Before pouring the concrete into the next element, these wooden boards have to be removed. This means in other words that a high amount of work is needed for the closing of the formwork and for the removal of the closing boards.

The element mentionned above, according to the European patent application No. 289 261 refers to a screed rail for the casting of floorings and it contains the idea to foresee openings for the pushing through of reinforcing irons and to provide the element with a steel mesh extending over the openings. However, this element is only foreseen for a narrow application range.

From DE-U-8 625 714 is known a joint formwork element corresponding to the prior art described in the above mentioned European patent application, that is, comprising relatively narrow openings through which it is difficult to pass reinforcing irons through. Also, this element is relatively heavy and only foreseen for the erection of ceilings and walls.

SUMMARY OF THE INVENTION

It is therefore an object of the present invention to realize an element of construction which can be used in particular also as a shuttering element for the formwork for the erection of walls and which is approriate to remain in situ. The element which solves this problem is characterized in that its longitudinal sides have a step, whereby both outside edges have the same finish as the construction work to be erected.

In a preferred embodiment, a reinforcing mesh of synthetic material is used which is completely surrounded by concrete, in order to render impossible any corrosion.

In order to take into account the usual arrangement of the reinforcing irons and the like, the openings are rectangular and disposed in two rows.

The invention will be explained further by way of an example of execution.

DESCRIPTION OF THE PREFERRED EMBODIMENT

Figures 1, 2, 3:
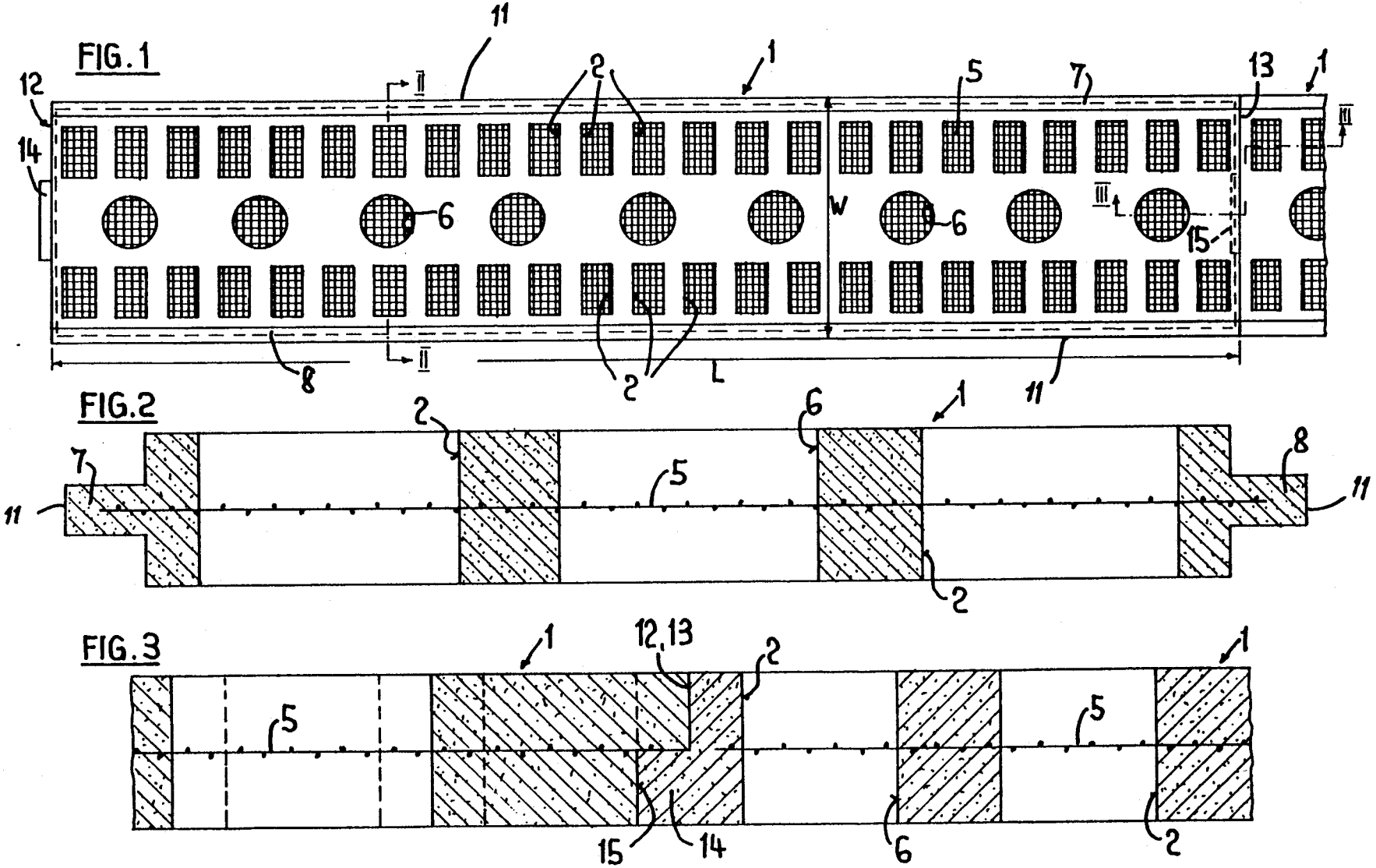
FIG. 1 shows a plain view of a device according to the invention.
FIG. 2 shows a section along the line II—II of FIG. 1.
FIG. 3 shows a section along the line III—III of FIG. 1.

The device of the example of execution according to FIG. 1 consists of a prefabricated element 1 using a relatively fine concrete and with a width W, which corresponds to the thickness of the wall to be erected (see FIGS. 4 or 5) and of a modular length L. The element can be a flooring, a ceiling or a wall or the like.

The present example comprises two rows of rectangular openings 2 through which the reinforcement irons 3 can be pushed. According to FIG. 6, it is also possible to insert other conducts 4, for example tubes for electrical leads or the like pipes. In the middle of the thickness of the concrete element is disposed a mesh of synthetic material which imparts to the concrete on the one hand a greater solidity and breaking strength and on the other hand it prevents the outflow of the poured concrete. It is clear that the breaking strength of the mesh of synthetic material is chosen in such a manner that the pushing through of the of the reinforcement irons and tubes etc. needs not too much power. According to the width of the concrete element 1, openings 6 may be provided in the middle of the element, these openings having essentially the function of decreasing the weight of the element. In the case of narrower elements, the middle row is not meaningfull nor necessary.

Figure 4:
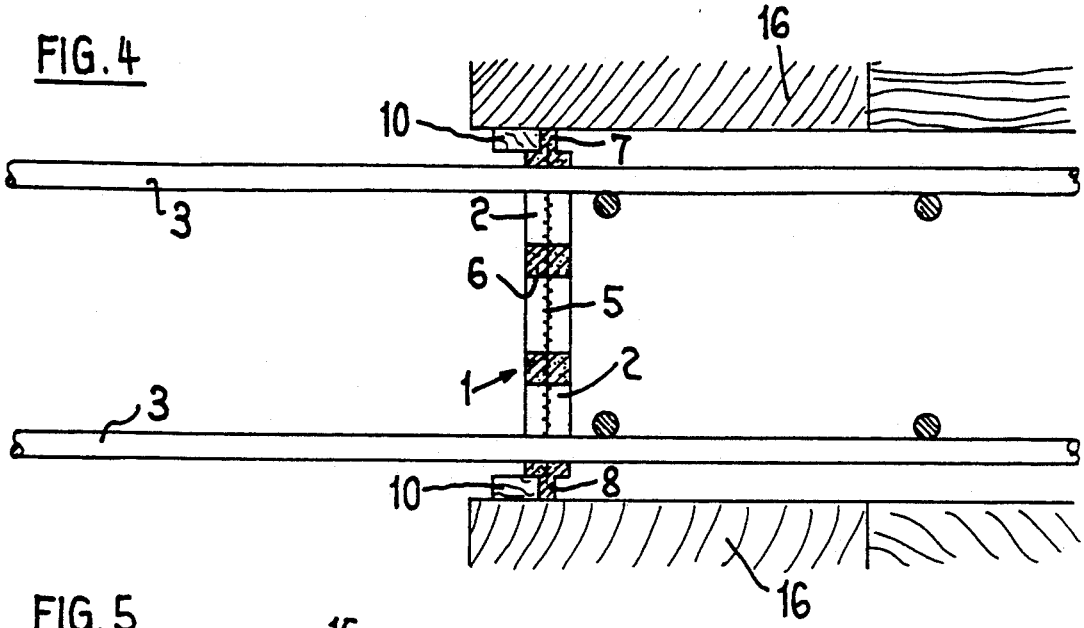
FIG. 4 shows the device according to FIG. 1, in the lodged condition.

FIG. 2 shows a section of the element in which both longitudinal borders 7 and 8 comprise a step with respect to both faces, the objective of the steps being clearly indicated in FIG. 4 where the element is held in the correct position by means of two abutments 10 of the formwork 16. For the fabrication, it is important that both outside edges 11 of the element are smooth, in order to have at least the same finish as the wall to be erected, since they are visible in the terminated wall.

Because it is inappropriate to fabricate great elements which are difficult to manipulate and because the shipment for example by pallets demands a certain amount of normalization, it is appropriate to provide the elements with a modular length L, for example of 125 cm. The width is variable, normaly between 15 and 50 cm, according to the thickness of the wall to be erected, whereby these indicated figures can vary from region to region , resp. country to country.

In order to guarantee a precise assembly in the longitudinal direction, by maintaining the spacing of the openings, the front sides 12 and 13 are each provided either with a protruding shoulder 14 or a recessed shoulder 15 which are mutually complementary in the thickness as shown in FIG. 3. From FIG. 1, it is further clearly to be seen that the mesh of synthetic material does not extend over the whole area of the element but is somewhat smaller in order to be completely contained in and protected by the concrete.

The size, form and number of the openings 2 is determined according to the kind of the construction work to be erected and according to the execution, resp. the arrangement of the reinforcing irons etc., which is utilized. Possible is for example a ratio of 1 to 2 of the sides of the rectangular openings and a graduation of five.

For a necessarily rational and rapid fabrication of a high number of such elements it has been found that the elements are advantageously fabricated in a horizontal position, whereby the utilization of fine concrete material with quick taking binder is preferred. It is of importance that during this operation the outside edges 11 remain smooth and clean.

Such elements may be used everywhere where walls, floorings, and ceilings are produced by sections and more particularly also for crane recesses. Due to the fact that the elements contain no reinforcement irons, it is easy to cut them at the required length in situ, if required. Because the element is an integral element of the construction work to be erected, it is necessary that the whole element is not attacked by the concrete. This is the reason why the use of concrete for the production of the elements is particularly advantageous. However, also other materials may be used for determined applications, for example non-oxidizing metals.

Figure 5:
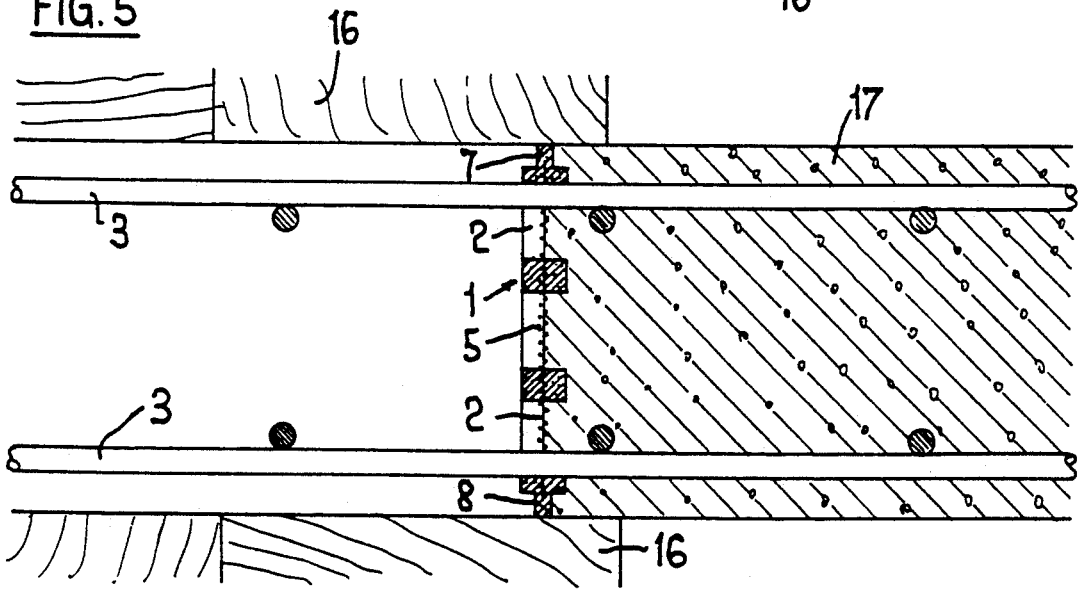
FIG. 5 shows the device according to FIG. 4 after the pouring of the concrete.
Figure 6:
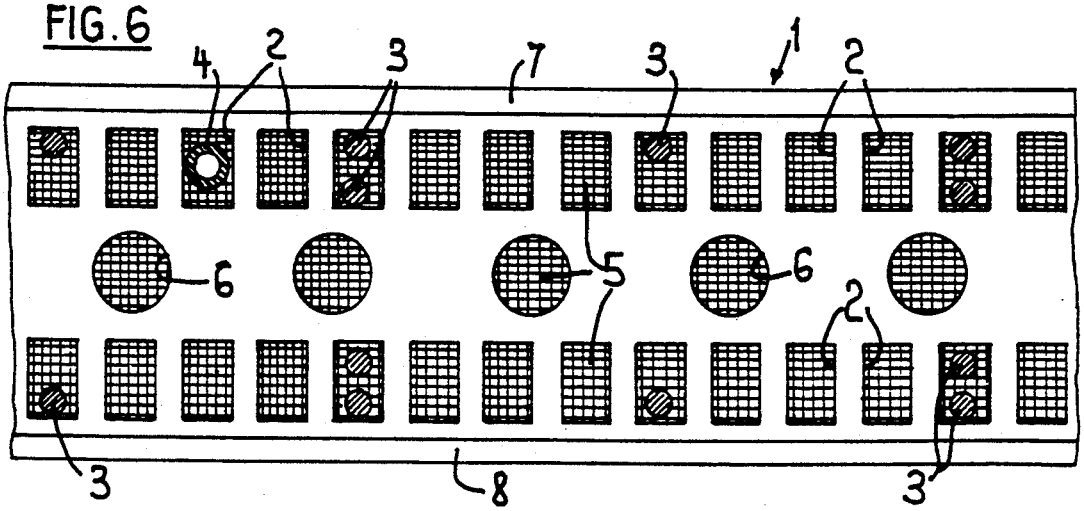
FIG. 6 shows the device according to FIGS. 4 or 5 seen from the front.

FIGS. 4 and 5 illustrate both steps at the time of the pouring of concrete into the formwork 16, whereby in FIG. 5 the erected concrete ceiling 17 is visible and the formwork 16 was pushed toward the left in order to receive the joining concrete ceiling. One sees also that the element 1 remains in the ceiling and is integrated there. Further, FIG. 6 shows that this element produces a shear interconnection between both parts of the wall.

I claim:

1. A construction element for limiting the fore part of a formwork, wherein said element is prefabricated of concrete, with a width corresponding to the thickness of a construction work to be fabricated and a modular length, comprising openings arranged in rows to allow the pushing through of reinforcing irons, pipework, or tubes and being provided with a reinforcement mesh which extends over said openings and prevents an outflow of concrete when concrete is poured into a formwork containing said element, wherein outside longitudinally extending edges of said element are provided with a finished surface generally matching a finish of a construction work to be erected, said element including longitudinally extending stepped portions on opposite sides of each of said outside longitudinally extending edges, and said element including a protruding shoulder at one end and a recessed shoulder at an opposite end, said shoulders being mutually complementary with respect to one another such that a plurality of said construction elements can be abutted end-to-end in precise alignment.

2. An element according to claim 1, wherein said reinforcing mesh is made of synthetic material and does not extend over the whole area of the element, whereby outer edges of said mesh are completely surrounded by concrete.

3. An element according to claim 1, wherein said openings are disposed in two rows and have a rectangular shape.

4. A construction element for limiting the fore part of a framework, wherein said element is prefabricated of concrete, with a width corresponding to the thickness of a construction work to be fabricated and a modular length, comprising openings arranged in rows to allow reinforcing irons, pipework, or tubes to be pushed therethrough and being provided with a reinforcement mesh which extends over said openings and prevents an outflow of concrete when concrete is poured into a formwork containing said element, wherein outside longitudinal edges of said element are each provided with a finished surface generally matching a finish of a construction work to be erected, and wherein said element includes longitudinally extending stepped portions on opposite sides of said finished surfaces, said stepped portions providing means for receiving an abutment for holding the element in place between side members of a formwork.

5. A construction element according to claim 4, wherein said construction element includes a protruding shoulder at one end and a recessed shoulder at an opposite end, said shoulders being mutually complementary with respect to one another such that a plurality of said construction elements can be abutted end-to-end in precise alignment.

6. A prefabricated construction element for use in a formwork for pouring concrete, comprising:

a generally rectangular-shaped concrete body having a modular length, a width corresponding to a thickness of a construction work to be fabricated, and a thickness;

openings arranged along the length of said concrete body and extending through said thickness of said body to allow reinforcing irons, pipework, or tubes to be pushed therethrough;

a reinforcement mesh disposed within said concrete body in a plane generally perpendicular to said thickness and extending across said openings to prevent an outflow of concrete when concrete is poured into a formwork containing said element;

wherein outside longitudinally extending edges of said element are each provided with a finished surface generally matching a finish of a construction work to be erected, and wherein said element includes longitudinally extending stepped portions on opposite sides of each of said finished surfaces, said stepped portions providing means for receiving an abutment for holding the element in place between side members of a formwork.

7. A construction element according to claim 6, wherein said construction element includes a protruding shoulder at one end and a recessed shoulder at an opposite end, said shoulders being mutually complementary with respect to one another such that a plurality of said construction elements can be abutted end-to-end in precise alignment.

* * * * *